United States Patent [19]

Masters

[11] 4,421,150

[45] Dec. 20, 1983

[54] WATERPROOF BAG DEVICE FOR ARTICLES

[76] Inventor: William E. Masters, 138 Norris Ave., Liberty, S.C. 29657

[21] Appl. No.: 282,454

[22] Filed: Jul. 13, 1981

[51] Int. Cl.[3] ..... B65D 30/08; B65D 33/16

[52] U.S. Cl. ..... 383/61; 206/811; 383/3; 383/86; 383/90; 383/91

[58] Field of Search ..... 150/3, 7, 52 J; 206/522, 811

[56] References Cited

U.S. PATENT DOCUMENTS 3,203,551 8/1965 Van Loan, Jr. ..... 150/7 X
3,998,304 12/1976 Edgerton, Jr. et al. ..... 150/3 X
4,155,453 5/1975 Ono ..... 150/7 X
4,262,801 4/1981 Avery ..... 150/7 X

*Primary Examiner*—William Price
*Assistant Examiner*—Sue A. Weaver
*Attorney, Agent, or Firm*—Dority & Flint

[57] ABSTRACT

A bag device A is disclosed having a waterproof enclosure D contained within an outer case B having a cover flap C which fastens over a closure 18 by means of a yieldable fastener 20, 22 to seal an article within enclosure D in a generally airtight waterproof environment. Air entrapped therein provides buoyancy and a safety fastener E maintains the closure 18 sealed should cover flap C become unfastened under pressure such as when fallen upon during whitewater boating.

7 Claims, 4 Drawing Figures

WATERPROOF BAG DEVICE FOR ARTICLES

BACKGROUND OF THE INVENTION

The present invention relates to a waterproof bag device for containing articles in an airtight waterproof environment. The bag device includes a safety closure which maintains the mouth of a waterproof inner enclosure in a folded configuration in the event a cover flap of the bag becomes unfastened. The bag device is particularly suitable for canoeing and kayaking and other sports wherein it is desirable to contain articles such as a camera in a waterproof bouyant bag for protection against water damage and loss.

Heretofore, prior devices have been developed for containing articles in a waterproof environment which are buoyant such as U.S. Pat. No. 4,155,453. However, this bag is rather large and bulky and requires considerable space in a kayak or canoe type boat. Zipper-type closure have been found not entirely satisfactory when used around sand and water in boating and are susceptible to breakage. Another watertight bag is disclosed in U.S. Pat. No. 3,998,304 which includes a closure having a pair of flaps which are folded and sealed with Velcro in a duffle-type bag.

Another problem to which attention need be given is that of protecting the closure of an airtight bag in which air has been captured for buoyancy from pressure exerted when weight is exerted on the bag such as when a boater falls or steps on the bag. While a yieldable closure such as a pressure sensitive fastener will protect the closure from damage by becoming unfastened, the waterproof environment is destroyed and the articles lost if the boat capsizes as the boater falls against the bag.

Accordingly, an important object of the present invention is to provide a generally airtight waterproof bag device having an improved closure.

Yet another important object of the present invention is to provide a waterproof bag device having a safety closure which maintains the waterproof environment thereof should a yieldable cover flap closure become unfastened.

Still another object of the present invention is to provide a simple reliable waterproof bag for containing articles and the like during use in boating which is simple and inexpensive and provides a reliable yet unbreakable closure for the waterproof environment.

SUMMARY OF THE INVENTION

The above objectives are accomplished according to the present invention by providing an outer case having flexible sides with a back side being extended to provide a cover flap which is attachable to a front side by means of Velcro fastening tape. A waterproof inner enclosure is sewn within the outer case which includes an extended mouth portion for insertion of an article which may be folded upon itself to provide a tight seal for the inner bag. Strap means carried across the cover flap is secured to a back side of the bag by means of Velcro fastening tape in such a manner that the strap maintains the closure of the inner enclosure in a folded sealed configuration should the cover flap become unfastened by exertion of pressure on the bag.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
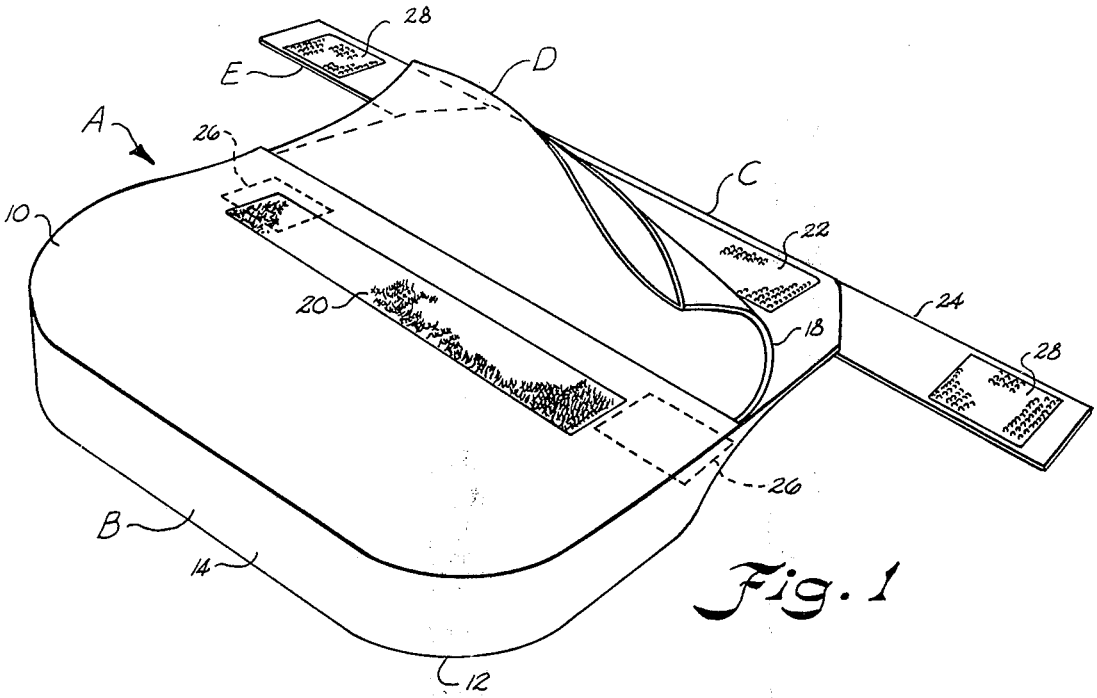
FIG. 1 is a perspective view illustrating a bag device constructed according to the present invention.

The drawing illustrates a waterproof bag device designated generally as A for containing articles in a generally airtight, waterproof environment which includes an outer case B defined by flexible sides and a cover flap C provided by an extension of a first of the flexible sides having sufficient length to be folded over a second of the sides. An inner generally waterproof enclosure D is carried within the outer case B which includes a foldable closure means having an open mouth to permit insertion of articles therein which provides a generally airtight waterproof environment. Fastening means is provided for fastening the cover flap C over the closure means in a folded configuration to seal the inner enclosure. A strap means E is carried by the cover flap and is attachable to the outer case to retain the closure means in its folded sealing configuration after the cover flap becomes unfastened upon sudden impacts.

Referring now in more detail to the drawing, the outer case B is defined by flexible sides which are illustrated as including a front side 10 and back side 12 and a gusset 14 joining the front and back sides. Cover flap C includes an extension of the back side 12 of the bag. The outer case is preferably formed from a fabric woven from nylon in a plain weave pattern.

Figure 3:
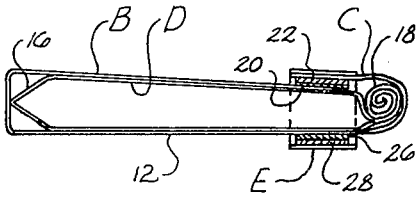
FIG. 3 is a sectional view taken along line 3—3 of FIG. 2.
Figure 2:
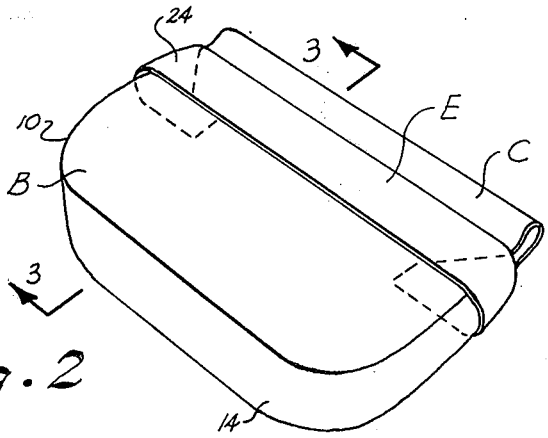
FIG. 2 is a perspective view illustrating a waterproof bag device constructed according to the present invention in a closed and sealed configuration.

The inner enclosure D includes a vinyl or rubber like liner which is inserted within the outer casing B and stitched therein so as to create a mouth flap portion 18 extending past the termination of the front side 10 of outer case B which provides a closure means. The closure means 18 may be rolled or folded in a configuration as best seen in FIG. 3 to provide a tight seal for the waterproof, airtight environment within enclosure D.

A first pressure sensitive fastening means is provided for the cover flap C which includes a strip of Velcro hook material 20 carried on front side 10 of outer case B and a complementary strip of Velcro loop material 22 carried on the mating face of the cover flap C. The Velcro fastening means yields to pull by cover flap C whereby the cover C becomes unfastened when a certain force and pressure is exerted on the bag.

The bag device A may be filled with an article and air entrapped therein so as to be buoyant. Should the bag be fallen or stepped upon by a boater or other weighty object as occurs when a boat such as a canoe or kayak is going over rocks and the like under whitewater boating conditions, cover flap fastener 20, 22 will yield before breaking.

Strap means E is provided by an elongated strip of nylon or canvas webbing 24 which has a sufficient length to wrap around the side gussets 14 of the outer bag B and attached to the back side 12. Means for attaching the cover strip so as to secure the strip is provided by Velcro fastening tape 26 carried at spaced locations on the back side 12 and complementary Velcro tape 28 carried on opposing marginal ends of the strap.

Figure 4:
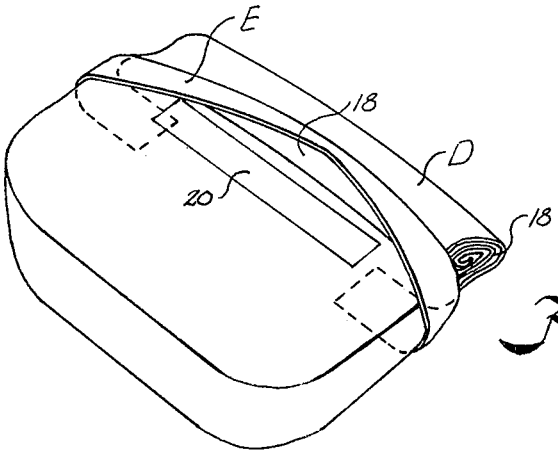
FIG. 4 is a perspective view illustrating the bag of FIG. 2 wherein the front cover flap has become unfastened while the cover strap retains the inner enclosure in a folded sealed configuration.

It will be noted as best seen in FIGS. 3 and 4, that strap means C is located to cover the corners of the outer case B such that the strap means retains the closure means 18 of the inner enclosure D in its folded sealed configuration, after cover flap C becomes unfastened, so as to maintain the article in a buoyant waterproof environment. Corners of closure 18 are entrapped by strap 24 retaining same folded. As such, strap E and fastening means 26, 28 provide a second fastening means for maintaining closure 18 sealed.

Upon exertion of sufficient pressure, fastening means 20, 22 will open allowing closure 18 to unroll slightly before being stopped by strap 24 relieving pressure without adverse loss of waterproofness or buoyancy.

While a preferred embodiment of the invention has been described using specific terms, such description is for illustrative purposes only and it is to be understood that changes and variations may be made without departing from the spirit or scope of the following claims.

What is claimed is:

1. A waterproof bag device for containing articles in a generally airtight waterproof environment comprising:

an outer case defined by flexible sides;

a cover flap extension carried by a first of said flexible sides having a sufficient length to be folded over a second of said sides;

an inner generally waterproof enclosure carried within said outer case forming and providing an air tight waterproof enclosure in which said article is contained and providing buoyancy to said bag device;

foldable closure means carried by said inner enclosure having an open mouth to permit insertion of articles in said inner enclosure and being foldable to provide a generally airtight waterproof environment and seal;

fastening means fastening said cover flap to said outer case with said cover flap folded over said closure means to maintain said closure means folded and said inner enclosure sealed and airtight;

strap means carried by said cover flap attachable to said outer case securing and retaining said closure means in said folded sealing configuration upon said fastening means and cover flap becoming suddenly unfastened by sudden exertion of pressure on said bag device by sudden impact against said bag so that said airtight and waterproof environment is maintained in said inner enclosure after opening of said fastening means facilitating initial release of pressure upon said impact without loss of buoyancy or waterproofness.

2. The device of claim 1 including first pressure sensitive fastening means carried on said second side of said outer case for fastening said cover flap and second pressure sensitive fastening means carried on said first side for attaching said strap means allowing said first fastening means to yield upon impact while said strap means and second pressure sensitive fastening means remain attached.

3. The device of claim 1 including pressure sensitive fastening means carried by said first side of said outer case and said strap means for attachment thereof, said strap means having a sufficient length to permit said strap means to wrap around said outer case for attachment to said first side.

4. The device of claim 1 wherein said strap means extends across corners of said outer case and cover flap to hold opposing ends of said folded closure means retaining same intact with said cover flap unattached.

5. The device of claim 1 wherein said fastening means includes pressure sensitive fastening means yielding upon impact to allow said cover flap to become unattached without damage while said strap means retains said closure means folded and said articles in a waterproof environment.

6. The device of claim 1 wherein said fastening means includes a yieldable fastener which yields and opens without damages thereto upon being stressed by pressure on said bag device.

7. A bag device for containing articles in a generally airtight waterproof environment comprising:

a flexible outer case having an inner enclosure;

said inner enclosure being constructed of an impervious material providing an airtight waterproof environment therein rendering said bag device buoyant;

closure means for sealing said inner enclosure;

cover flap means carried by said outer case foldable over said closure means;

first fastening means fastening said cover flap and outer case together;

second fastening means securing said cover flap and outer cases; and said first fastening means being yieldable to open upon sufficient pressure exerted upon said bag to accommodate sudden impact while said second fastening means remains fastened to retain said closure means in said sealed configuration maintaining said airtight waterproof environment within said inner enclosure to preserve the buoyancy and waterproofness of said bag device.

* * * * *